United States Patent [19]

Scherzinger et al.

[11] 4,271,495

[45] Jun. 2, 1981

[54] ELECTRONIC CLOCK WITH A CHIME SYSTEM

[75] Inventors: Bernhard Scherzinger, Esslingen; Hans Flaig, Schramberg, both of Fed. Rep. of Germany

[73] Assignee: Gebruder Junghans GmbH, Schramberg, Fed. Rep. of Germany

[21] Appl. No.: 95,239

[22] Filed: Nov. 19, 1979

[30] Foreign Application Priority Data

Nov. 20, 1978 [DE] Fed. Rep. of Germany ..... 2850286

[51] Int. Cl.[3] ..... G04C 21/12; G04B 47/00; G10F 1/00; G10H 1/02

[52] U.S. Cl. ..... 368/75; 84/1.03; 84/1.26; 340/384 E; 368/10; 368/245; 368/273

[58] Field of Search ..... 58/13, 38 R, 152 R; 84/1.01, 1.03, 1.26, DIG. 12; 340/384 E

[56] References Cited

U.S. PATENT DOCUMENTS

| | | | |
|---|---|---|---|
| 3,759,029 | 9/1973 | Komaki | 58/21.12 |
| 4,073,133 | 2/1978 | Earls et al. | 58/13 |
| 4,090,349 | 5/1978 | Takase | 58/23 R |
| 4,101,885 | 7/1978 | Blum | 340/384 E |
| 4,172,359 | 10/1979 | Gorsky et al. | 58/38 R |

*Primary Examiner*—Edith S. Jackmon

*Attorney, Agent, or Firm*—Burns, Doane, Swecker & Mathis

[57] ABSTRACT

An electronic clock with a chime system has exclusively electronic processing for production of a variety of tone signal sequences consisting of known melodies or portions thereof and time-identifying sequences of strokes. The characteristic values of these tone signal sequences are loaded into a ROM memory and can be recalled, as required, by electronic control and release circuits at each quarter, half, three quarter or full hour. The amplitude of the audio output signals is automatically controlled in accordance with the time of day.

12 Claims, 5 Drawing Figures

AUDIO MIXERS
CURVE GENERATORS
AUDIO GENERATORS
TONE SELECT CIRCUITS
ROM
CENTRAL CONTROL UNIT
(FIG. 3)
TIMER
DIVIDER
MOTOR DRIVE
(FIG. 4)
12 TONE GENERATOR
TONE MIXER
CLASS B AMP.
AMP.
MOTOR
OSC.
JC
T1
T2
T3
T4
S1
S2
S3
$V_{DD}$
$V_{SS}$

ELECTRONIC CLOCK WITH A CHIME SYSTEM

BACKGROUND OF THE INVENTION

The present invention relates to an electronic clock with a chime system and more particularly to such a clock in which predetermined time signal sequences are electronically reproduced at certain times of the day.

Clocks with chime systems in which the indication of the time is accomplished electronically are known in the art. However, in such clocks, the sequence of acoustic strokes to be generated at specific time periods is accomplished primarily by mechanical means.

It is therefore an object of the invention to provide a novel electronic clock with a chime system in which the acoustic signals are also generated exclusively by electronic means and in which the capability to produce different tone signal sequences far exceeds that of known chime systems.

SUMMARY OF THE INVENTION

This, as well as other objects and advantages of the present invention, is accomplished by providing an electronic clock with a memory circuit into which is loaded at least one time signal sequence and from which the tone signal sequence is synchronously recalled during predetermined time periods. Polyphonic sound generation can be accomplished by feeding the recalled data into a plurality of tone selection circuits, and from there into audio spectrum generating circuits to produce several output frequencies. The output frequencies can be fed into audio spectrum mixing circuits for appropriate combining and thence to envelope curve generators to provide proper decay of the reproduced signals.

A clock with a chime system constructed in accordance with the present invention has an advantage in that certain sequences of strokes can be generated electronically every quarter of an hour and every hour, and certain chime melodies can be produced hourly in the same manner. The signal generation, as well as the selection of sequences of chime melodies and tones, is performed entirely by electronic means. The electronics required for these purposes can be easily installed within a clock casing in compact units, together with a few external adjusting, selection and function-triggering switches and an electro-acoustic converter. The result will be a clock with chime system which can be produced at substantially lower costs than standard clocks with chime systems and which can fully meet present-day requirements for such clocks due to the great number of variations that are possible in the course of its operation.

DETAILED DESCRIPTION

Figure 1:
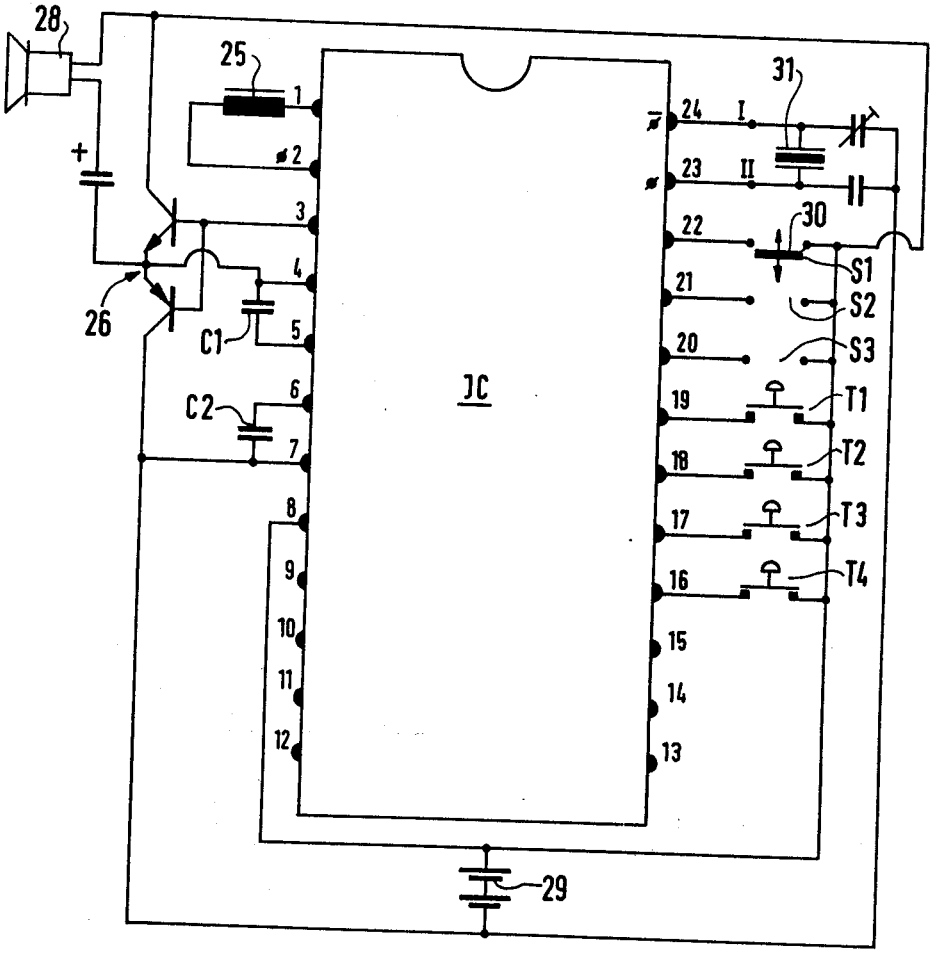
FIG. 1 is a schematic circuit diagram of the IC chip connections for the preferred embodiment of a chime system.

The lay-out of an electronic clock having a chime system is illustrated in partial schematic and partial block diagram form in FIG. 1. The circuit components for the clock are all combined into one integrated circuit chip IC. This integrated circuit has several input terminals and output terminals denoted by the numerals 1 to 24. A first motor output terminal 1 and a second motor output terminal 2 are connected to a suitable conventional stepping motor 25 which drives a clockwork mechanism in a known manner for the indication of hours, minutes and seconds. The circuit IC further includes a melody output terminal 3, an input terminal 4 for negative voltage feedback and output terminals 5 and 6 for a low-pass filter. The filter comprises two capacitors C1 and C2 which form, together with a current-amplification stage 26 located outside the chip IC, the external section of a push-pull class B-amplifier 27. The other components of the amplifier are located inside the chip IC (see FIG. 2). A loudspeaker 28 is connected to the output terminal of the current-amplification stage 26.

A terminal 7 for the negative voltage supply potential and a terminal 8 for the positive voltage supply potential are respectively connected by wires with the terminals of a battery 29. The battery is also connected to other terminals of the chip IC for the purpose of voltage supply to other components of the clockwork system, as explained in further detail hereinafter. The input or output terminals 9 to 15 of the chip IC are not connected in the illustrated example. They can be reserved for additional functions which could be assigned to the clockwork system, such as alarm-triggering or special timing functions, for example. The terminals 9 to 15 can be connected with external activating and deactivating means for an alarm and/or special timing as well as with internal memory addresses for the processing of alarm and/or special timing data.

A plurality of external switches T1, T2, T3 and T4, which can be actuated by push-buttons, for example, are connected between input terminals 16 to 19 and the positive potential terminal of the battery 29. Three additional switches S1, S2 and S3 are selectively connected between input terminals 20, 21 and 22, respectively, and the positive voltage potential terminal of the battery 29 by means of a three-position slide switch 30. It is also possible to use a push-button switch with a latching mechanism for the alternate opening and closing of each of the switches S1, S2 and S3, instead of a sliding actuator. A quartz oscillator 31 for generating a stabilized output frequency, such as 4.194 MHz, for example, is connected to the last two input terminals 23 and 24 of the chip IC.

Figure 2:
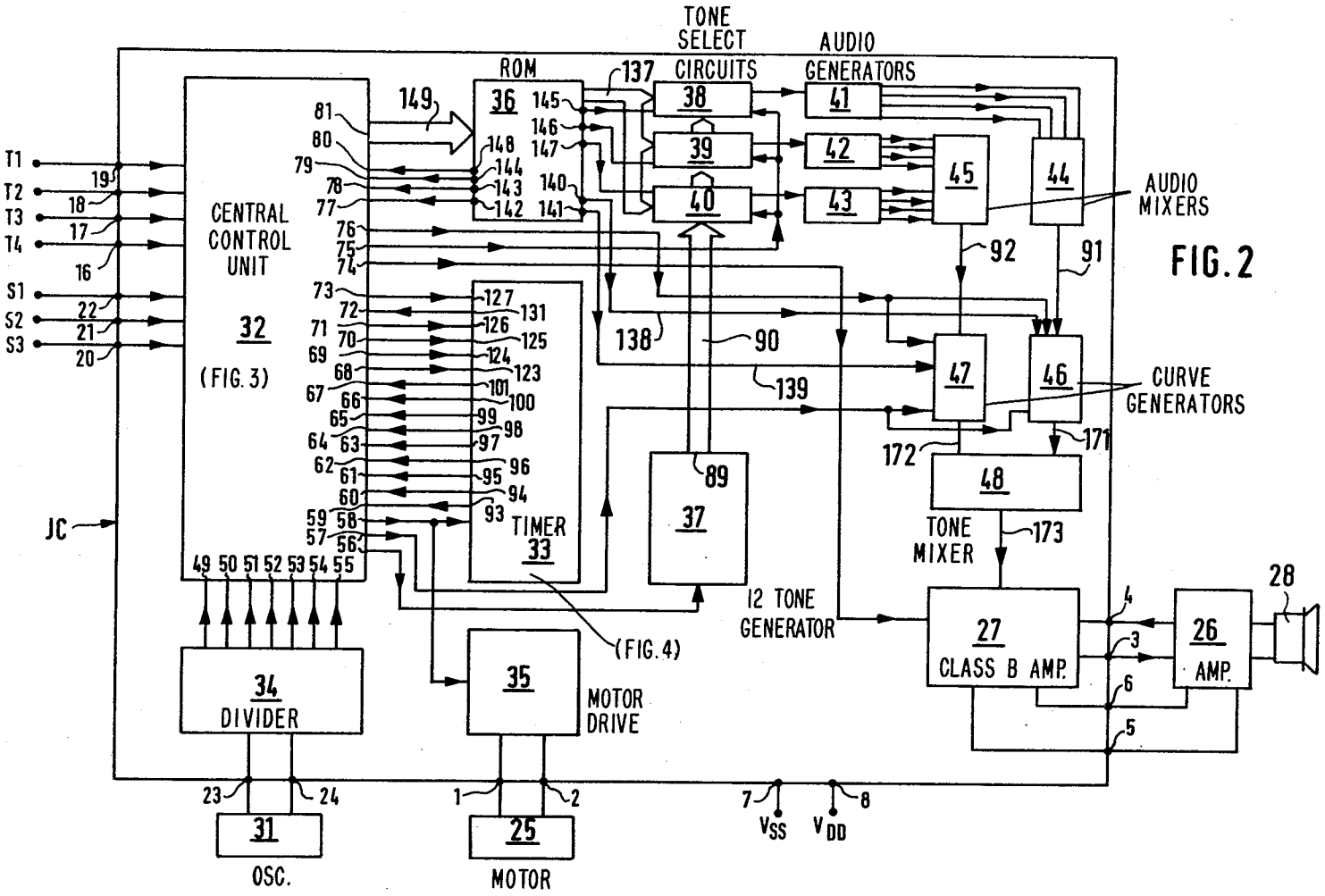
FIG. 2 is a block diagram of the chime system.
Figure 3:
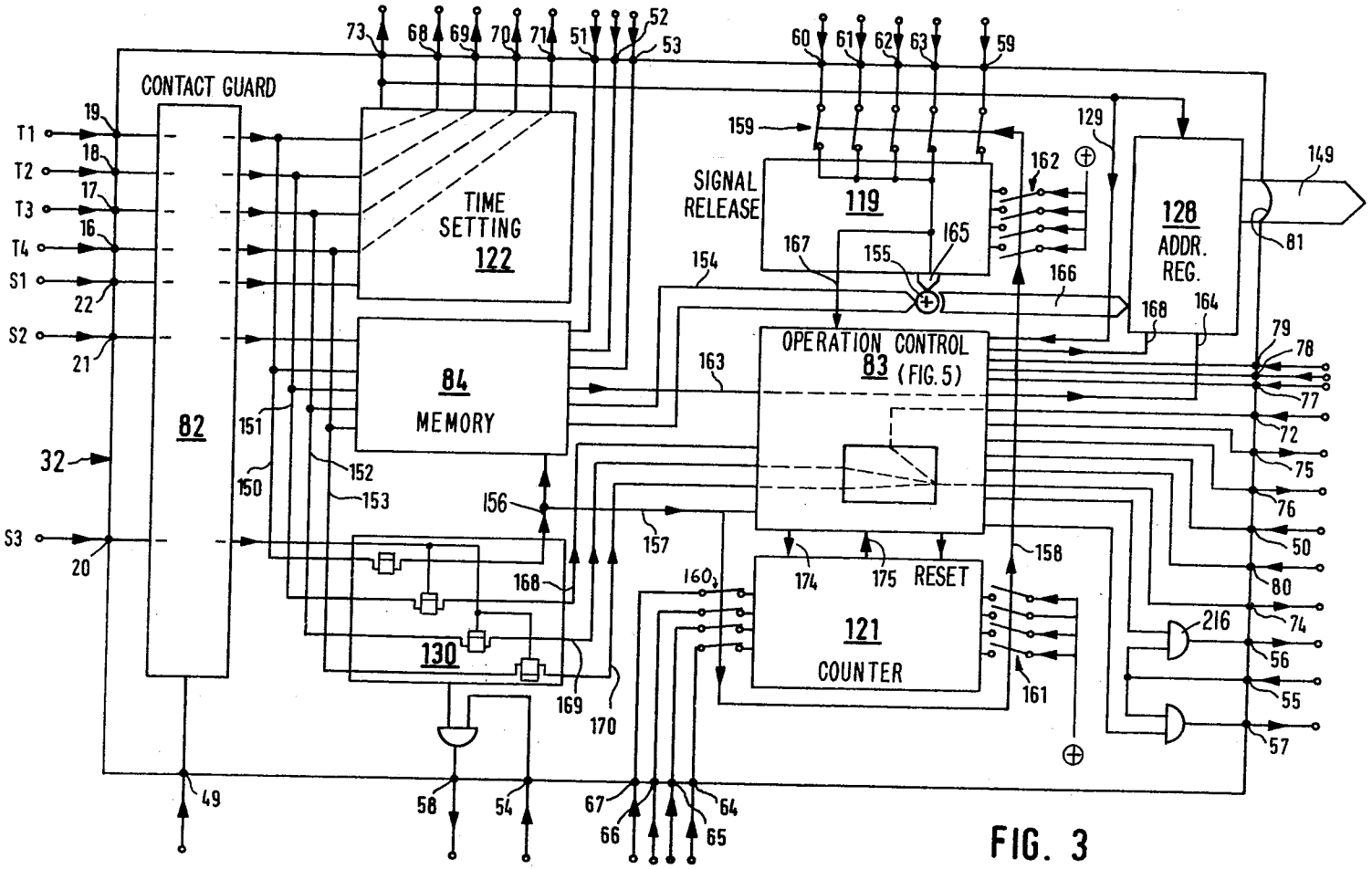
FIG. 3 is a block diagram of a central control unit for the chime system.
Figure 4:
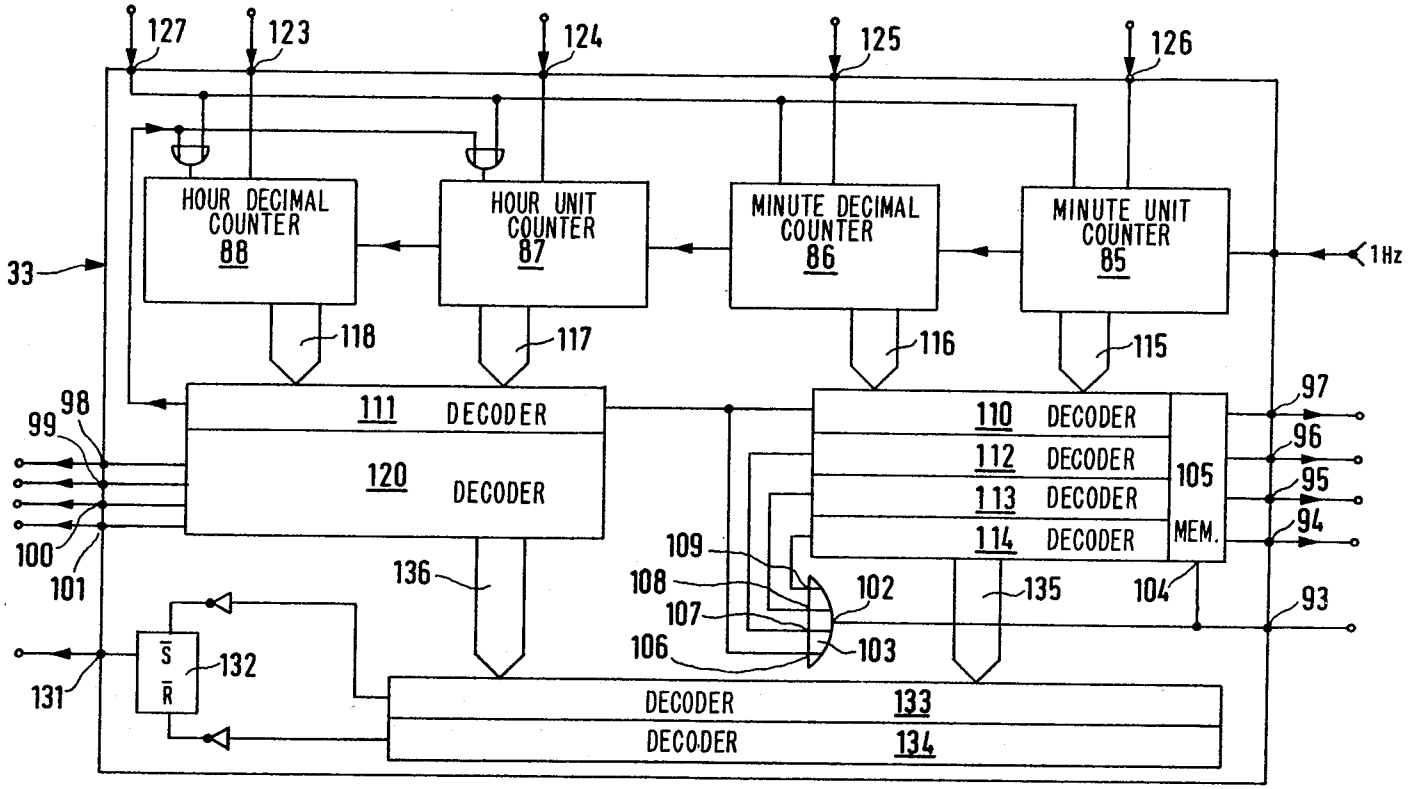
FIG. 4 is a block diagram of a central timer unit for the chime system of a clock.

The internal components and their connections, as well as the signal paths within the integrated circuit IC, are illustrated in block diagram form in FIG. 2. The chip IC contains a central control unit 32 (illustrated in detail in FIG. 3), and a central timer unit 33 (illustrated in detail in FIG. 4). A frequency-divider circuit 34 both drives the quartz oscillator 31 and divides its output frequency into various output frequencies required for the chime system of the clock. A motor-driving circuit 35, a ROM memory 36 and a twelve-tone generator 37, which functions as a frequency converter, are all connected to the control unit 32. The ROM memory 36 can have $256 \times 11$ ($2^8$ byte) memory locations, for example, into which is loaded the data relating to a number of known melodies, such as "Bim-Bam," "Westminster," "Ave Maria" and "Wittington" for example, with the proper pitch, tone sequences and time-related sequence of strokes. It will be appreciated that the memory 36 can also be a RAM, PROM or EPROM.

Three tone-selection circuits 38, 39 and 40, three audio-spectrum generating circuits 41, 42 and 43 as well as two audio-spectrum mixing circuits 44 and 45, are arranged within the chip IC. The chip IC further contains two envelope-curve generators 46 and 47 as well as a tone-sequence mixing circuit 48.

The central control unit 32 has, in addition to the input terminals 16 to 22 which are identical with the chip terminals 16 to 22, internal input and output terminals 49 to 81. The input terminals 49 to 55 of the central control unit 32 are respectively connected with the associated output terminals of the frequency-divider circuit 34. A signal with a frequency of $\frac{1}{8}$ Hz, for example, is continuously applied to one input terminal 49 and fed into a contact-guarding circuit 82 (FIG. 3) which is a component of the central control unit 32 and releases pulses coming from push-button switches T1 to T4 and selective switches S1 to S3 for further processing by the central control unit 32 only if the respective switch signal is longer in duration than a pulse in the signal appearing at the input terminal 49. An accidental erroneous triggering of the chime system is thus avoided by the contact-guarding circuit.

A clock pulse signal is continuously applied to another input terminal 50 for driving an operational control circuit 83 (FIGS. 3 and 5) which is also a component of the central control unit 32.

Clock pulses are continuously applied to the input terminals 51 to 53 of the central control unit 32 to govern the cycle of the chime melodies which are to be produced at specific times. The pulses are loaded, by means of appropriate connections, into a 4-bit melody-selector memory 84 (FIG. 3) of the central control unit 32.

A signal having a frequency of 1 Hz, for example, is continuously applied to an input terminal 54 and is fed by means of the output terminal 58 of the central control unit into the motor-driving circuit 35 for timed control of the stepping motor 25 to thereby control the time indication carried out through the motor 25. This signal at the output terminal 58 also functions to synchronize the counters of the timer unit 33 with the time indication. The timer unit 33 includes a minute unit counter 85 into which the 1 Hz signal is fed. The minute unit counter 85 is followed in series by a minute decimal counter 86, an hour unit counter 87 and an hour decimal counter 88.

The undivided output signal of the oscillator circuit 34 appears at the input terminal 55 of the central control unit 32. This signal can have a frequency of 4.194 MHz, for example. This signal is fed by way of the output terminal 56 of the central control unit 32 into the twelve-tone generator 37 where it is divided downwardly into twelve semitones of an octave, beginning, for example, with the low frequency of 7.84 KHz and ending with the top frequency of 14.8 KHz, with a maximum variation of 0.2% of an equally tempered scale. These frequencies of the twelve semitones appear at the output terminal 89 of the twelve-tone generator 37 and are transmitted from there by a twelve-wire conductor 90 to each of the three tone-selection circuits 38, 39 and 40 for further processing.

The individual oscillator output signal is also transmitted by way of the output terminal 57 of the central control unit 32 to the two envelope-curve generators 46 and 47 where the signal is processed to obtain a decaying signal similar to an exponential function, to attenuate a tone signal produced by the two audio-spectrum mixing circuits 44 and 45 and transmitted thereto by way of connecting lines 91 or 92, respectively. In the course of this operation the oscillator output signal is divided down in a manner such that the decay function of a sound being reproduced is subdivided into at least 16 steps per-second, with the attenuation being completed after three seconds, for example, without influencing the audio spectrum.

The input terminals 59 to 67 of the central control unit 32 are connected with the associated output terminals 93 to 101 of the timing unit 33.

The output terminal 93 of the timing unit 33 is connected to the output terminal 102 of an OR-gate 103 (FIG. 4) as well as with the output terminal 104 of a 4-bit memory 105. The OR-gate 103 has four input terminals 106, 107, 108 and 109. The first input terminal is connected to a decoder 110 for a 4/4-hour signal release as well as to a decoder 111 for a time-synchronous switching at 2400 hours. The second input terminal 107 of the OR-gate 103 is connected to a decoder 112 for a $\frac{3}{4}$-hour signal release, the third input terminal 108 to a decoder 113 for a $\frac{1}{2}$-hour signal release, and the fourth input terminal 109 with a decoder 114 for a $\frac{1}{4}$-hour signal release. The data of these decoders 110 to 114, as well as that of the decoders 120, 133 and 134, which are designed in the form of reference and memory circuits, is compared continuously with the data of the counters 85 to 88, whose stored counts are transmitted to the decoders by associated data transmission channels 115 to 118. If the counts stored in the counters 85 and 86 coincide with the data of the associated decoders 110, 112, 113 and 114, a synchronization signal will appear at every $\frac{1}{4}$, $\frac{1}{2}$, $\frac{3}{4}$ and full hour at the output terminal 102 of the OR-gate 103. The synchronization signal passes from the output terminal 93 of the timing unit 33 to the input terminal 59 of the central control unit 32 and from there to a suitable conventional signal release circuit 119 (FIG. 3) to start the production of a chime signal.

Along with the synchronization signal, a quarter hour identifying signal is generated and fed into one of the input terminals 60, 61, 62 or 63 of the central control unit 32 by way of one of the four output terminals 94, 95, 96 or 97 respectively connected with one of the decoders 110 to 114. The proper input terminal is selected in accordance with the specific quarter hour. In the central control unit 32 the quarter hour identifying signal is fed to the signal release circuit 119.

In addition to the synchronization signal and the full hour identifying signal, a binary-coded signal for the instantaneous hour appears at each full hour at the output terminals 98 to 101 of the timing unit 33. This signal characterizes the full hour and is generated by a decoder 120 which is associated with the decoder 111. The decoder 120 is capable of coding the hours 1 to 12, and its data is compared with the results of hour-counters 87 and 88 by way of the data transmission channels 117 and 118. In the case of coincidence, the coded signal characterizing the full hour is fed in accordance with the binary-code to the associated input terminals 54, 65, 66 and 67 of the central control unit 32, and from there into a 4-bit counter circuit 121.

The output terminals 68 to 71 of the central control unit 32 are connected to a time setting control unit 122. These output terminals are connected with the external switches T1–T4 by way of the time setting control unit 122 and the input terminals 16 to 19. The output terminals 68 to 71 are further connected, by way of the input terminals 123 to 126 of the timing unit 33, with the four counters 85 to 88 respectively. Thus, circuit paths are established from the switch T1 to the hour decimal-counter 88, from the switch T2 to the hour unit-counter 87, from the switch T3 to the minute decimal-counter 86 and from the switch T4 to the minute unit-counter 85. The switch S1 is also connected to the time-setting control unit 122 by way of the input terminal 22 of the central control unit 32.

The time is stored in the counters 85 to 88 in the following manner: By closing the switch S1, a reset signal is applied to all counters 85 to 88 by way of the output terminal 73 of the central control unit 32 and the input terminal 127 of the timing unit 33, with the result that their registers are reset to "zero." At the time of the closing of the switch S1, an address register 128 for the ROM memory 36 within the central control unit 32 is set at a specific address. The same signal which sets the address also transits a command to the operational control unit 83 (FIG. 3) by way of a line 129 to turn off the melody. As long as the switch S1 remains closed, the registers of the counters 85 to 88 of the timing unit 33 will remain unchanged and the pulse feed to the stepping motor will be interrupted.

With the switch S1 closed, it is possible to set the actual time of the day. Each closing of the switch T1 will increase the count of the hour decimal-counter 88 by one unit. The feeding of additional time data is accomplished in the same manner by the actuation of swtiches T2, T3 and T4. For example, to set a time of 18:39 into the counters 85 to 88, the switch T1 is actuated one time, the switch T2 eight times, the switch T3 three times and the switch T4 nine times.

If switch S1 is now opened and switch S3 is closed, the counters 85 to 88 of the timing unit 33 are activated precisely to the second, and after one second the pulses to the stepping motor 25 are restarted. The switch S3 is now connected with an input memory 130 (FIG. 3) by way of the input terminal 20. An output terminal 131 of the timing unit 32 is connected with the input terminal 72 of the central control unit 32. An RS-flip-flop 132 (FIG. 4) is connected to this output terminal 131. The R-input terminal of this flip-flop is connected to a decoder 133 in which is permanently stored a time, for example 8:15 hours. The S-input terminal of the flip-flop 132 is connected with a decoder 134 in which is stored another time, for example 20:15 hours. These two decoders 133 and 134 are components of an automatic high/low device which makes it possible to play a tone signal sequence, released by the system, at a high volume during the period of 8:15 to 20:15 and at a low volume during the period of 20:15 to 8:15. The data in the two decoders is continuously compared by way of control lines 135 and 136 with the registers of the counters 85 to 88 so that a "low" or "high" signal will appear at the output terminal 131, depending on the time of the day. This signal is fed into the operational control unit 83 of the central control unit 32 and transmitted by way of its output terminal 74 as a command to the push-pull class B amplifier 27 for setting the proper volume control.

The output terminal 76 of the central control unit 32 connects the operational control unit 83 with the two envelope-curve generators 46 and 47. As soon as a time starting command signal from the operational control unit 83 appearing at the output terminal 76 reaches the envelope-curve generators 46, 47, the generators are activated by means of signals appearing on lines 138 and 139, which are respectively connected to the output terminals 140 and 141 of the ROM memory 36. The envelope-curve generators are programmed on the basis of a bit-pattern which is furnished by the ROM memory 36.

The input terminals 77, 78 and 79 of the central control unit 32 connect the operational control unit 83 and the output terminals 142, 143 and 144, respectively, of the ROM memory 36. A binary-coded signal for writing data into the tone-selection circuits 38 to 40, such as a double-stroke, for example, will appear at these three output terminals. The tone-selection circuits 38 to 40 are connected by way of appropriate lines with one of the output terminals 145 to 147 of the ROM memory 36. Another output terminal 148 of the ROM memory is connected by way of the input terminal 80 of the central control unit 32 with the operational control circuit 83. A signal, traveling from the ROM memory 36 over this line to the operational control circuit 83, marks the end of a completed chime melody. This "end of melody" information can consist of a stop-byte with bits 0 to 4 activated. The address counter 128 will retain this address until a new starting address is entered one quarter of an hour later.

The output terminal 81 of the central control unit 32 connects the several output channels of the address counter 128 to the ROM memory 36 by means of a transmission line 149. The several addresses for the producable chime melodies formed by bit-patterns are addressed at, and called from the ROM memory 36, by way of these channels.

The functions which result from the operation of the switches T1 to T4 in connection with the closing of switches S2 and S3 will now be described. When the switch S2 is closed, it is possible to select, by means of switches T1 to T4 and by way of lines 150 to 153, one of the four melodies stored in the ROM memory 36 without any interference with the function and operation of the timing unit 33 or the motor-driving circuit 35. Closing of the switch S2 activates the 4-bit melody selector memory 84, making it possible to select one melody by closing one of the four switches T1 to T4 which is associated with this specific melody. The 4-bit melody selection memory 84 retains this selection until another melody is selected by the closing of one of the other switches T1 to T4. When one of the switches T1 to T4 is closed, a partial starting address for the melody selected is generated and transmitted by way of channel 154 to a switching element 155.

Closing of the switch S3 will activate the write-in memory 130 and allow, by closing of the switches T1 to T4, the triggering of the following functions: The closing of switch T1 triggers a test function where, for the purpose of demonstrating the clock to a prospective buyer, it becomes possible to display the sequence of strokes to be produced at a certain time, for example 3:00 hours, as well as one of the four melodies stored in the ROM memory 36, for example "Westminster"; the latter being accomplished without interfering with the function and operation of the timing unit 33.

When the test function is triggered, the switch T1 causes the opening of logical test switches 159 or 160 respectively by way of line 150, the write-in memory 130, its output line 156, a connection line 157 to the operational control unit 83 and a control line 158, thus cutting off the connections between the input terminals 59 to 63 and 64 to 67 and the components of the central control unit 32 as well as the connections between the signal release circuit 119 and the reference circuit 121 respectively, with the result that timing unit 33 cannot deliver release signals to the central control unit 32. On the other hand, logical test switches 161 are closed and the testing time of 3:00 hours is binary-coded in the reference circuit 121. Also closed at the same time are the logical test switches 162 and a binary signal for a 4/4-hour stroke is loaded into the signal release circuit 119.

At the time of the triggering of the test function there is further introduced into the 4-bit melody selection memory 84 a signal by way of line 156, breaking its connection, by way of line 163, with the operational control circuit 83 and from there, by way of the line 164, to the address counter 128. At the same time the binary-code for the test melody "Westminster" is selected in the 4-bit melody selection memory 84. This binary-code generates a partial starting address for the selected melody which is transmitted over the channel 154 to the switching element 155.

Also transmitted to this switching element, by way of the channel 165, is the test-binary code of the signal release circuit 119. The two signals are combined at the switching element 155 to form a complete starting address and are fed by way of the channel 166 into the address counter 128. The signal release circuit 119 will transmit a synchronizing signal by way of line 167 to the operational control circuit 83 which in turn will transmit a starting signal derived from the first-mentioned signal, to the address counter 128 by way of line 168, thereby activating the address counter.

The sounds of the test melody, associated with a 4/4-hour stroke, as well as hour-indicating strokes, required for the test-time of 3:00 hours, will now be heard. After the last hour-indicating stroke, a flip-flop in the write-in memory 130 is reset so that a re-closing of the switch T1 will result in a replay of the chime melody and the sequence of strokes.

When the switch S3 is in its closed position and switch T2 is then closed, the following functional process will occur:

A bistable flip-flop within the write-in memory 130 is set by way of line 151 and the resulting signal is fed by way of a line 168 into the operational control circuit 83, rendering inoperative a triggering signal which is transmitted from the signal release circuit 119 to the operational control circuit 83 by way of the line 167. The acoustic chime function of the clock system is turned off completely. If the switch T2 is closed a second time, this memory flip-flop will be reset with the result that the proper connections will be restored and the chime function will thus be reactivated.

When the switch S3 is in its closed position and switch T3 is then closed, the following functional process will take place:

The closing of the switch S3 results in a resetting of a flip-flop in the write-in memory 130, generating a command signal, "high," for example, which is transmitted by way of a line 169 to the operational control circuit 83, and from there by way of the output terminal 74 to the push-pull class B amplifier 27 for the proper positioning of the volume control. If the switch T3 is now closed, the memory flip-flop is set again by way of the line 152 with the result that the opposite command ("low") will be delivered to the push-pull class B amplifier 27 over the same circuit path for a corresponding reduction in volume. If the switch T3 is closed a second time, the process will be repeated.

When the switch S3 is in its closed position and switch T4 is closed, the following functional process will take place:

The closing of the switch S3 results, as described previously, in resetting a flip-flop within the write-in memory 130 so that the melody, previously selected, will be reproduced at a high volume. When the switch T4 is closed, a signal is generated along line 153 which will reset the memory flip-flop. A command to the high/low automatic device is now transmitted by way of a line 170 from the write-in memory 130 to the operational control unit 83 and processed there. A signal, produced by the timing unit 33 and the two decoders 133, 134, is fed by way of the input terminal 72 of the central control unit into the operational control circuit 83. Depending on the specific desired time periods, whose ranges are defined by the decoders 133 and 134, there will be transmitted by the operational control unit 83 by way of the output terminal 74 of the central control unit a command "high" or "low" to the push-pull class B amplifier 27 for proper positioning of the volume control. During the period of 8:15 to 20:15 hours the tone signal sequence being generated will be reproduced at a high volume while it will be played at a low volume automatically during the period of 20:15 to 8:15 hours. A second closing of the switch T4 results in an override of this automatic device so that all sequences of signals will be reproduced at a high volume.

The three tone-selection circuits 38, 39 and 40 each consist of a 5-bit memory. They are activated in accordance with a desired melody and timing sequence by the ROM memory 36 through a time division multiplexing technique controlled by the address counter 28 of the central control unit 32. In the case of the illustrated preferred embodiment, three tone-selection circuits are utilized because it is desirable to generate at least one multisound tone and the three generators enable the first sound to persist while the subsequent sound or sounds are generated.

The audio-spectrum generating circuits 41, 42 and 43 have the function of converting the sound frequency delivered by the tone-selection circuits 38 to 40 into a full audio-spectrum. For this purpose, all sound frequencies (7.84 KHz to 14.8 KHz) which are fed by the twelve-tone generator 37 into the tone-selection circuits 38 to 40, and selected there as being suitable for a specific melody, are entered into each of the three audio-spectrum generating circuits 41 to 43 and stepped down there to form four diverse output frequencies. In the course of this operation, the input frequency is divided by four, as well as by six, by ten and by twenty. At the output terminal of the audio-spectrum generating circuit 41 there will therefore appear the full audio-spectrum of one single tone while at the output terminals of the two other audio-spectrum generating circuits 42 and 43 there will appear the audio-spectrum of a two-tone sound. The frequencies, divided in such a manner, are then fed into the two audio-spectrum mixing circuits 44 and 45 by way of the four output lines coming from each of the three audio-spectrum generating circuits 41 to 43. The mixing circuits produce in each case one output voltage, containing the amplitudes of the various four frequencies produced by the audio-spectrum generating circuits in the proportion of 1:1:1:1.

The two output voltages of the two audio-spectrum mixing circuits 44 and 45 are fed by way of connecting lines 91 and 92 into one of the two envelope-curve generators 46 and 47, and from there by way of connection lines 171 and 172 to the tone-sequence mixing circuit 48, where the two input audio frequencies are mixed at a 1:1 ratio. The resulting tone signal is then fed by way of a connecting line 173 into the push-pull class B amplifier 27 and from there into the loudspeaker 28 for the acoustic reproduction of the desired tone or sound.

The operation of a clock with a chime system after the setting of the proper time, the selection of the melodies, and its start by the closing of switch S3 will now be described.

When the timing unit 33 delivers a demand (every $\frac{1}{4}$, $\frac{1}{2}$, $\frac{3}{4}$ and full hour) for a chime melody to the signal release circuit 119 (by way of the input terminals 60 to 63 of the central control unit 32), this demand will be transmitted by the signal release circuit 119 to the operational control circuit 83 by way of the line 167, provided there is present a synchronizing signal (at the input terminal 59 of the central control unit 32). A melody starting address, composed of an identifying signal corresponding to the preselected melody, sent by the 4-bit melody selection memory 84 to the switching element 155 by way of channel 165, is entered in the form of a complete starting address into the address counter 128 by way of the channel 166. This process cancels the "end of melody" command which was present between the output terminal 148 of the ROM memory 36 and the input terminal 80 of the central control unit 32 at the operational control circuit 83, thus making it possible for the melody clock pulse, arriving by way of line 163 from the 4-bit melody selection memory 84, to pass through the operational control circuit 83 and to enter the address counter by way of the line 164.

As a result of these input clock signals, a shift register (FIG. 5) can be activated within the operational control unit 83. A signal is transmitted by way of the output terminal 75 of the central control unit 32 to the tone-selection circuits 38 to 40 and these circuits are loaded with tone frequencies which match the specific bit-pattern of the first tone of the chime melody stored in the ROM memory. The envelope-curve generators 46 and 47 are activated by an appropriate tone signal at the output terminal 76 of the central control unit 32. The register of the address counter 128 is incremented by one by means of a signal on its input line 164 so that the next byte, which contains all data for the tone to be subsequently generated, appears at the output terminals of the ROM memory 36.

These three occurrences are repeated until all tones of the chime melody, recalled from the ROM memory 36, have been processed. If at the end of the chime melody a demand for a 4/4-hour stroke has been entered into the operational control circuit 83 (by way of input terminal 63 of the central control unit 32 and line 167), the 4-bit counter and the reference circuit 121 are activated by way of a signal on a line 174 and a coded signal corresponding to the present number of hours is generated and transmitted by way of input terminals 64 to 67. This hour-marking signal triggers a sequence of acoustic strokes, their tones also being stored in the ROM memory 36. These tones are loaded into the tone-selection circuits 38 to 40 for further processing as in the case of the melody production, with the tone generation for the hourly strokes following substantially the same course as the generation of the chime melodies. The end of the sequence of strokes is marked by a 4 c/s signal which is transmitted by way of line 175 to the operational control circuit.

Figure 5:
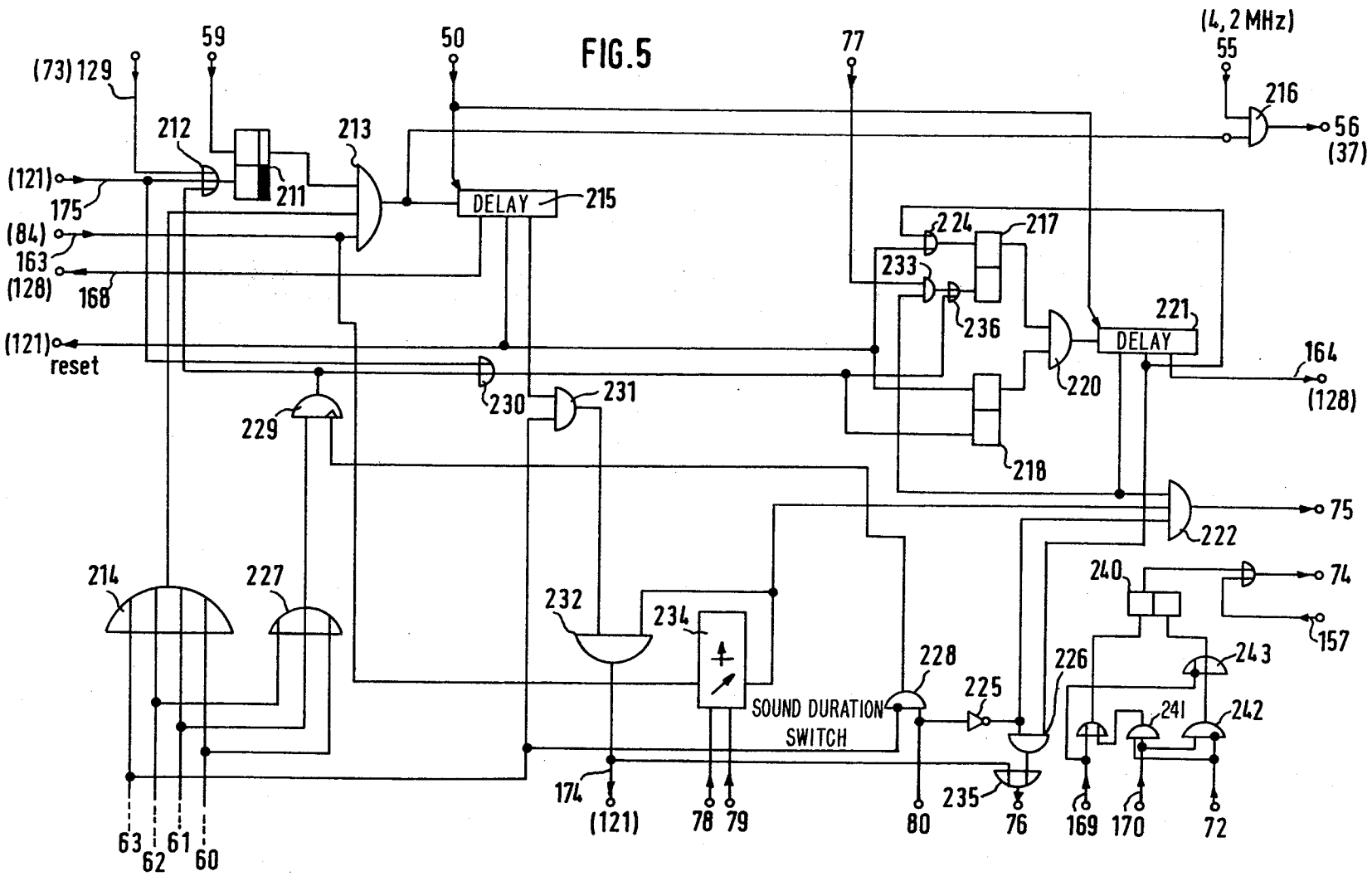
FIG. 5 is a schematic circuit diagram of the operational control circuit illustrated in FIG. 3.

Referring now to FIG. 5, one embodiment of an operational control circuit 83 is illustrated in detail in schematic circuit form. During the operation of the circuit to terminate the generation of music, a reset signal appears on the control line 129 and is transmitted by means of an OR-gate 212 to place a control toggle stage in a starting position. At each quarter of one hour, a sound request signal appears at the input terminal 59 and adjusts the control toggle stage 211. A series connected AND-gate 213 receives a signal from the toggle stage 211 and the output signal of an uncoupling gate 214, which is an OR-gate that combines the signals of the quarter hour recognition at the input terminals 60 to 63. This uncoupling gate may be present within the signal release circuit 119 of FIG. 3, but is also included in this description of the operational control circuit in order to facilitate the description thereof. As soon as a signal appears on the line 163 as a time or starting signal for a melody, the AND-gate 213 triggers a delay circuit 215 with output terminals that may be activated in a mutually time displaced manner, such as a sequence of trigger stages grouped into a shift register. The delay circuit 215 is synchronized by way of a control beat pulse sequence appearing at an input terminal 50. At the same time, the high frequency pulse sequence of the time keeping oscillatory circuit of the digital clock is transmitted by way of a coincidence gate 216 from the input terminal 55 to the output terminal 56 of the central control unit 32 to serve as a base frequency signal for the twelve tone generator 37.

The delay circuit 215 first produces a signal on the line 168 to produce, in the address counter 128, the formation of the starting address signal for the melody-call-off from the ROM storage 36. Then the comparator circuit 121 for striking the hour (FIG. 3) is reset into its starting position and the first and second melody toggle stages 217, 218 are set.

The toggle stages 217, 218 transmit starting information to a second delay circuit 221, by way of an AND-gate 220, as long as generation of the stored melody has not yet finished and therefore no termination signal appears at the input terminal 80. The delay circuit 221 can be constructed and may be synchronized in the same manner as the delay circuit 215. An AND-gate 222 is actuated to deliver a triggering signal for the sound selector circuits 38, 39, 40 at the output terminal 75 whenever the delay circuit 221 delivers it first signal. At the same time, the first melody-toggle stage 217 is reset, by way of an AND-gate 233, whenever the stored melody requires an intermodulation and therefore a signal from the ROM 36 appears on the input terminal 77. The result of this is that the second signal delivered by the delay circuit 221 again sets the first melody toggle stage 217 via an OR-gate 224, and thus the delay circuit 221 is again triggered immediately by way of the AND-gate 220. Independently of the fact whether or not the triggering of a turn is desirable, insofar as there is no melody ending signal as yet, the second output signal of the delay circuit 221, along with a signal from an inverter 225, triggers an AND-gate 226 to produce a signal on the output terminal for the actuation of the envelope generators 46, 47 to start the production of a sound.

At a later point in time, the delay circuit 221 delivers a starting signal on the line 164 as an increment signal to the address counter 128 in order to trigger and begin the reading of the information from the next following address of the melody storage ROM 36.

When the end of a finished quarter hour sound sequence is detected by the melody storage ROM 36 and a signal appears at the input terminal 80, the OR-gate 212 is triggered temporarily, by way of an AND-gate 229 with a dynamic input terminal. The control toggle stage 211 is again reset into its starting or rest stage by way of a selector gate 227, which comprises a quarter hour recognition device with the exception of the full hour, and by way of an inhibit-gate 228. Furthermore, the melody toggle stages 217, 218 are reset into their rest state by way of an OR-gate 230, 236.

In case of the full hour, i.e., when a signal appears on the quarter hour recognition input terminal 63, the production of sound is not yet to be stopped with the termination of the melody read out from the storage ROM 36, but a striking of the hour is supposed to follow. For this purpose, the inhibit-gate 228 is closed and the first delay circuit 215 delivers an additional starting signal which is tied to the hour recognition signal at the input terminal 63 by way of an AND-gate 231, to ready an AND-gate 232 for actuation.

The AND-gate 232 is cyclically actuated by a starting signal from a continuous signal circuit 234 which is responsive to the melody beat on the line 163, to produce strikings of the hour by way of an OR-gate 235 and the output port 76 to control the generation of the desired tone signal. In addition, counting pulses are delivered by means of line 174 to the counting and comparator circuit 121. Whenever the number of these counting pulses agree with the number corresponding to the instantaneous time, the comparator circuit 121 delivers an END-signal by way of the hour recognition line 175 and resets the control toggle stage 211 and the melody toggle stages 217, 218, until a request for the production of sound appears at the input terminal 59.

The sound duration switch 234 is shown in FIG. 5 as a bistable toggle stage, and its reset time is adjustable by means of control signals appearing on control terminal 78 and 79, which signals are generated by the storage ROM 36 to increase the clarity of the sound presentation. In order to synchronize the sound duration switch with the remaining switching process, and especially with the triggering of the circuits 215 and 221, the circuit is preferebly programmable. For example, the circuit can be based on the variable interrogation of divider circuit output terminals. The sound duration circuit 234 is triggered with the rhythm of the melody beat prevailing on the line 163 in order to create starting signals which last for a more or less large fraction of the beat period and thus determines the duration of the triggering of the gate 222 for the generation of sound by way of an output terminal 75, and the duration of the striking of the hour by way of the AND-gate 232 at full hours.

The control for the loudness level of the radiated sound is also a bistable toggle stage 240. Whenever the latter is set or whenever a test signal appears on line 157, the output terminal 74 for the triggering of the amplifier 27 for a high sound loudness level is activated. The toggle stage 240 is set into this position whenever the line 169 is triggered by way of a manual process, as described in connection with FIG. 3. or else, whenever the automatic circuit is turned on and an AND-gate 241 is prepared by the line 170, and the interrogation of the time of the clock shows a momentary time of the day by way of inlet 72 in which the sound radiation is not to take place with a decreased volume. An AND-gate 242 as well as a succeeding OR-gate 243, having an inverting input terminal, will reset the toggle stage 240 whenever no loud sound radiation is to take place.

In order to simplify the clarity of the description, all switching measures which are familiar to the expert have been omitted in the presentation of FIG. 5, in order to synchronize certain sequences of signals one with the other or to mutually displace them, such as bistable toggle stages switched by the control rhythm signal at the input terminal for the temporary intermediate storage of signals.

The present invention may be embodied in other specific forms without departing from the spirit or essential characteristics thereof. The presently disclosed embodiment is therefore considered in all respects as illustrative and not restrictive. The scope of the invention is indicated by the appended claims rather than the foregoing description, and all changes which come within the meaning and range of equivalency of the claims are therefore intended to be embraced therein.

What is claimed is:

1. An electronic clock having a chime system for electronically reproducing predetermined tone signal sequences at predetermined instances in time, comprising:

a source of a standard frequency signal;

a time indicating device operated at a rate corresponding to said standard frequency signal;

a memory circuit having data representing at least one tone signal sequence stored therein;

means for recalling the tone signal sequence data stored in said memory circuit synchronously with real time;

means responsive to said standard frequency signal for producing a plurality of different tone signals;

means responsive to the tone signal sequence data recalled from said memory circuit for selecting certain ones of said plurality of different tone signals;

audio-spectrum generating means for converting each of the tone signals selected by said selecting means into a plurality of different frequency output signals spaced throughout the audio-spectrum;

means for mixing said plurality of output signals for each selected tone signal and producing a signal having a voltage representative of the plurality of different frequencies;

means for decaying the voltage signal in accordance with a predetermined function;

means for combining the decaying voltage signals corresponding to the various selected tone signals; and means for converting the combined signals into an audible signal.

2. An electronic clock with a chime system as defined in claim 1, wherein each electronically reproduced tone signal sequence consists of at least one of a chime melody and an hour-identifying sequence of strokes.

3. An electronic clock with a chime system as defined in claim 1 or claim 2, wherein said memory circuit is a semiconductor memory having at least four tone signal sequences stored therein.

4. An electronic clock with a chime system as defined in claim 1 wherein said recalling means includes a central timer unit containing a plurality of counters into which can be fed the time of the day by the actuation of external control elements, and further including several logical memory and comparator circuits for comparing data stored therein with the contents of the counters and for furnishing an appropriate indentifying signal for the release of an assigned tone signal sequence at each quarter and each full hour.

5. An electronic clock with a chime system as defined in claim 4 wherein said recalling means further includes a central electronic control unit having control, memory and release selector circuits for the exact release and control of a tone signal sequence called for by the central timer unit.

6. An electronic clock with a chime system as defined in claim 1 wherein said means for producing a plurality of different tone signals includes a twelve zone generator for dividing said standard frequency signal into twelve different tone frequencies of an octave, ranging from a lower frequency of 7.84 KHz to a top frequency of 14.8 KHz.

7. The electronic clock with a chime system defined in claim 6 wherein said audio-spectrum generating means divides each selected tone signal by 4, 6, 10 and 20 to produce four different output signals therefrom.

8. The electronic clock of claim 7 wherein said mixing means combines said four different output signals in an equal proportionate ratio to produce said voltage signal.

9. The electronic clock of claim 8 wherein said decaying means attenuates said voltage signal in accordance with an exponential function in at least 16 steps per second such that the total decay of the signal is accomplished within three seconds.

10. The electronic clock of claim 9 wherein said combining means combines the decaying voltage signals in an equal proportionate ratio.

11. The electronic clock with a chime system defined in claim 4 further including a volume control circuit for providing a relatively low volume for a generated tone signal sequence throughout a certain time period, and a relatively high volume for a tone signal sequence throughout another time period, further wherein said central timing unit includes memory and comparator circuits having data relating to a specific time of the day stored therein for continuous comparison with the contents of said counters, said volume control circuit being responsive to the states of said memory and comparator circuits to control an amplifier in said converting means.

12. The electronic clock with a chime system defined in claim 11 wherein said amplifier comprises a class B push-pull amplifier with a low pass filter and a current amplification stage.

* * * * *